United States Patent [19]

Sakamaki et al.

[11] Patent Number: 4,648,818

[45] **Date of Patent: * Mar. 10, 1987**

[54] ROTARY SLEEVE BEARING APPARATUS FOR A ROTARY COMPRESSOR

[75] Inventors: Hiroshi Sakamaki, Utsunomiya; Susumu Sugishita, Hanyu; Yukio Horikoshi, Kazo; Kikuji Yanagihashi, Yono, all of Japan

[73] Assignee: Nippon Piston Ring Co., Ltd., Tokyo, Japan

[ * ] Notice: The portion of the term of this patent subsequent to Apr. 30, 2002 has been disclaimed.

[21] Appl. No.: 777,877

[22] Filed: Sep. 20, 1985

Related U.S. Application Data

[63] Continuation of Ser. No. 616,812, Jun. 4, 1984, abandoned.

[30] Foreign Application Priority Data

Jun. 9, 1983 [JP] Japan ..... 58-101714

[51] Int. Cl.[4] ..... F04C 18/348

[52] U.S. Cl. ..... 418/173

[58] Field of Search ..... 418/173, 71, 83

[56] References Cited

U.S. PATENT DOCUMENTS 3,834,842 9/1974 Dorff et al. ..... 418/71

4,479,763 10/1984 Sakamaki et al. ..... 418/173

4,514,156 4/1985 Sakamaki et al. ..... 418/173

FOREIGN PATENT DOCUMENTS 709820 8/1931 France ..... 384/114

*Primary Examiner*—Leonard E. Smith

*Attorney, Agent, or Firm*—Birch, Stewart, Kolasch & Birch

[57] ABSTRACT

Apparatus in a vane type rotary compressor for floatingly supporting a rotary sleeve which is mounted in a center housing for rotation with a plurality of vanes movable in a rotor, the apparatus comprising an air-bearing room defined between the inner periphery of the center housing and the outer periphery of the rotary sleeve and supplied with the maximum-pressure or discharge-pressure air through an air-supply passage extending from the discharge chamber or compression working space under the maximum pressure. The air-supply passage is formed with an accumulator for reducing the pulsations and/or temperature of the supplied air. The accumulator is composed of either or both of a relatively large hollow in the thickened wall of the center housing and a plurality of fine bores and alternative grooves forming a S-shaped hole in the suction side wall.

9 Claims, 7 Drawing Figures

ROTARY SLEEVE BEARING APPARATUS FOR A ROTARY COMPRESSOR

This application is a continuation, of application Ser. No. 616,812 filed on June 4, 1984, abandoned.

BACKGROUND OF THE INVENTION

1. Field of the Invention

The present invention relates to improvements in rotary sleeve bearing apparatus for a rotary compressor which is utilizable as a supercharger for an internal combustion engine and provided with a rotary sleeve mounted in a center housing for rotation with a plurality of vanes movable in a rotor which is eccentrically disposed in the rotary sleeve.

2. Description of the Prior Art

A movable vane compressor of the type having a rotary sleeve supported by compressible fluid such as air is utilizable as a supercharger for an automobile engine required to run over a wide speed range. The rotary sleeve rotates together with a plurality of vanes to prevent frictional heat and wear at the apex of each vane. And yet it has the possibility of scuffing and seizure troubles if air is highly compressed in the compression working space confined among the rotary sleeve, the rotor and the adjacent vanes to push the rotary sleeve from within to the inner periphery of the center housing. In Japanese Patent Application Serial Number Sho 58-28608, the inventors of this application have proposed to supply air to an air-bearing room between the inner periphery of the center housing and the outer periphery of the rotary sleeve through an inlet which is internally connected to one of the discharge chamber, the compression working space under the maximum pressure, or the open air. The supplied air increases the flowing of air along an area of the compression side inner periphery of the center housing to protect scuffing between the rotary sleeve and the center housing. It is desirable for the air-bearing room to be supplied with the high-pressure air in the compression working space or discharge chamber. However, the supplied air has a pulsating pressure which results from a cyclical change of the compression ratio in the compression working space causing pulsation of air both in the compression working space and in the discharge chamber internally connected thereto. The pulsation in the air supplied into the air-bearing room may vibrate the rotary sleeve. Especially, in high-speed and high-load operations, the pulsation not only causes the rotary sleeve to contact the inner periphery of the center housing but also the vane to vibrate against the inner periphery of the rotary sleeve with the result that scuffing between the rotary sleeve with the center housing and wearing between the rotary sleeve and the vanes. Another problem is that, as the temperature rises in the discharge chamber or compression working space, the air supplied to the air-bearing room is insufficient in density to increase the bearing performance of the air-bearing room.

It is the primary object of the present invention to provide a rotary-sleeve bearing apparatus for a rotary compressor in which the air-bearing effect is less affected by the pulsation and temperature of the air which is extracted from the discharge chamber or compression working space and supplied to the air-bearing room.

SUMMARY OF THE INVENTION

To attain the object as described above, the invention consists in the apparatus for a rotary compressor provided with a rotary sleeve rotatably mounted in a center housing, a rotor disposed within the rotary sleeve, a plurality of vanes movable fitted in the rotor, and a discharge chamber, the apparatus comprising a thin air-bearing room defined between the center housing and the rotary sleeve, an inlet provided in the inner surface of the center housing on which the rotary sleeve would be pressed by compressed air, and an air-supply passage extending to said inlet from either or both the discharge chamber and a compression working space under the maximum pressure, wherein the air-supply passage is provided with an accumulator.

The accumulator is formed as a hollow portion in the center housing. A relatively large hollow in the wall of the center housing is used for absorbing pulsations in the air extracted from the discharge chamber or compression working space. A plurality of fine bores in the suction side wall serves to lower the temperature of the extracted air. Therefore, an accumulator is preferably shaped in the form of a combination of at least a large hollow in the thickened wall of the center housing with a plurality of fine bores in the suction side wall.

One of the advantages offered by the present invention is that the rotary sleeve in the compressor is free from surging even if high temperature and pulsating air is supplied to the air-bearing room for supporting the rotary sleeve, because the supplied air has its pulsation and temperature reduced by the inventive accumulator before entering the air-bearing room. Another advantage is that the air-bearing room prevents the rotary sleeve from contacting the center housing by the help of air sufficient in pressure and density even when the compressor runs at high speeds. In contrast, the known apparatus without an accumulator supplies the hot pulsating air to the air-bearing room in which the pulsation causes the rotary sleeve to surge and scuff to the center housing. Also the poor density of hot air fails to increase the bearing capacity. All in all, the apparatus of the present invention allows the compressor to require less torque over a full speed range than the conventional apparatus.

BRIEF DESCRIPTION OF THE DRAWINGS

One way of carrying out the present invention is described in detail below with reference to drawings which illustrate preferred embodiments, in which.

DETAILED DESCRIPTION OF THE INVENTION

Figure 1:
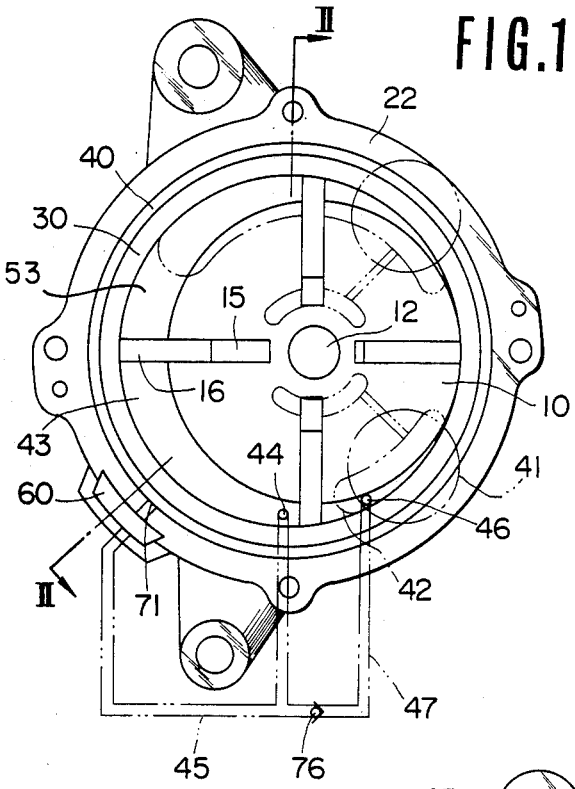
FIG. 1 is a side elevation of the rotary compressor provided with the apparatus of the invention, the rear side housing of which is removed for convenience.

Referring initially to FIG. 1 in which the rotary compressor has a rotor 10 fixed to a rotor shaft 12, the rotor is eccentrically disposed in a rotary sleeve 30 to rotate in the direction as indicated by an arrow. The rotor 10 has a plurality of vanes 16 radially, movably fitted in the respective vane grooves 15. The vane 16 has its apex in contact with the inner periphery of the rotary sleeve 30. The rotary-sleeve 30 is floatingly supported in an air-bearing room 40 defined between the outer periphery of the rotary sleeve and the inner periphery of the center housing 22. The width of the air-bearing room 40 is exaggeratedly illustrated but really less than 0.1 mm.

Two adjacent vanes 16, while turning, form a compression working space 43 in the suction side and a suction working space 53 in the suction side of the compressor, respectively. The compression working space 43 has its maximum pressure immediately before internally connected to the discharge chamber 41 through the discharge port 42. An extract port 44 is provided to extract the maximum pressure air from the compression working space and another extract port 46 is provided in the discharge chamber 41. An inlet 71 is provided at the starting point of an area to which the rotary sleeve 30 is pushed from within by compressed air in the compression working space 43 and connected to the extract port 44 with the intervention of an air-supply passage 45. The another extract port 46 is connected to the air-supply passage 45 by an auxiliary passage 47 in which a check valve 76 is mounted. The air-supply and auxiliary passages 45, 47 are formed in the center housing but illustrated by imaginal lines as were outside the housing for convenience.

The compression-side thickened-wall of the center housing 22 is formed with a hollow portion used as an accumulator 60, which is interposed between the inlet 71 and the air-supply passage 45.

Figure 2:
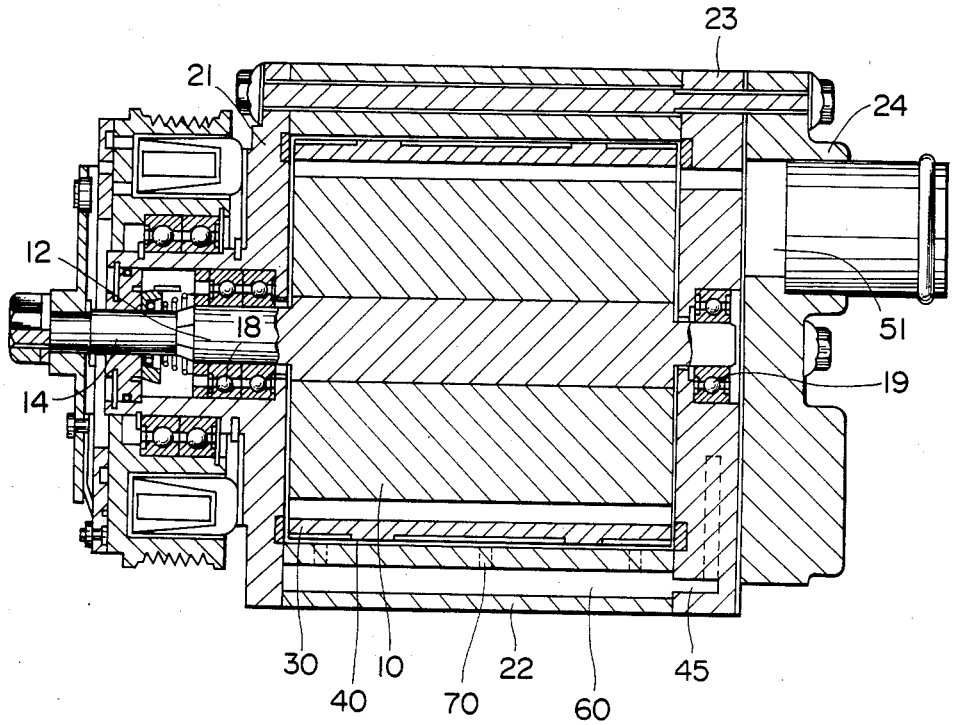
FIG. 2 is a section taken along the line II—II of FIG. 1.

As seen in FIG. 2, rotor 10 is integrally shaped with a shaft 12 rotatably supported by bearings 18, 19 in the respective front and rear side housings 21, 23 and fixed at the front end thereof to a pulley 14 which is rotated by an engine. A gasket is interposed between the rear side housing 23 and the rear cover 24 in which the discharge chamber and the suction chamber 51 are provided. The air-supply passage 45 is connected to the entrance of the accumulator 60 the exit of which opens to the air-bearing room 40 between the center housing 22 and the rotary sleeve 30 through the inlet 71 which consists of axially aligned openings.

Upon rotation of the rotor 10 of the compressor of FIGS. 1 and 2, air is gradually compressed in the compression working space 43 defined between the two adjacent vanes 16 and has its maximum prssure immediately before the compression working space 43 is internally connected to the discharge chamber 41. The maximum pressure air is extracted through the extract port 44 to the air-supply passage 45 and supplied to the air-bearing room 40 from the inlet 71 at the starting point of the area to which the rotary sleeve 30 is pushed from within by the compressed air in the working space 43 so as to increase the bearing ability of the room. The increased air flowing on the area prevents a direct contact between the rotary sleeve 30 and the center housing 22 when the rotary sleeve 30 is pushed to the area by the high-pressure air in the compression working space 43. In the initial, low and middle speed operations, the air having a pressure higher than the discharge pressure is supplied to increase the bearing effect of the air-bearing room 40 with the result that the rotary sleeve 30 is prevented against direct contact with the center housing 22.

When the rotor rotates at high speeds in which the air-bearing room 40 needs air more than what can be extracted from the compression working space, the pressure in the air-supply passage 45 descends below the discharge pressure to open the check valve 76, thereby allowing the discharge chamber 41 to supply air to the air-bearing room 40. The discharge chamber 41 can supply sufficient air, in volume and pressure, to the bearing room 40, though its pressure is lower than the maximum in the working space. Thus, the air-bearing room 40 is capable of preventing a direct contact between the rotary sleeve 30 and the center housing 22.

Each rotation of the rotor causes a cyclic change of pressure in the compression working space, so that air pulsates in the space and the discharge chamber internally connected to the space. The pulsating air is extracted and introduced through the air-supply passage 45 to the accumulator 60, in which the air has its pulse absorbed. Thereafter, the air without pulses is supplied through the inlet 71 to the air-bearing room 40, whereby the rotary sleeve 30 is free from surging due to pulsating air. The higher the running speed, the large effect the accumulator will have. Without the accumulator, the rotary sleeve would be adversely influenced by the pulsation in the air supplied to the air-bearing room, especially in high-speed operations.

Figure 3:
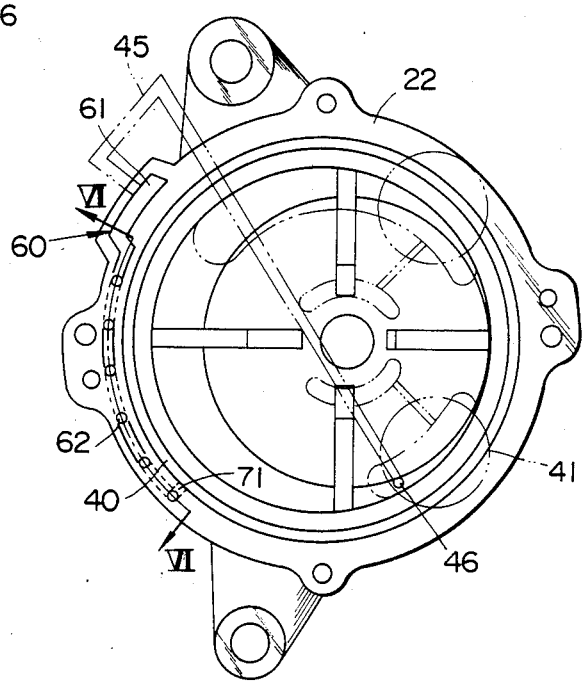
FIG. 3 is a view of another embodiment, similar to FIG. 1.
Figure 4:
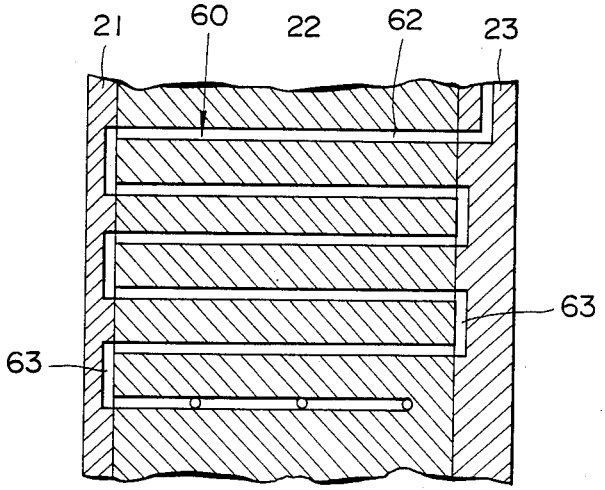
FIG. 4 is a section taken along the line IV—IV of FIG. 3.

Referring to FIG. 3 in which is shown another embodiment, the accumulator 60 is composed of a relatively large hollow portion 61 and a plurality of relatively fine bores 62 respectively formed in the suction-side wall of the center housing 22. The fine bores 62 in the center housing 22 are connected in the form of a S-shaped line by intermittent grooves 63 formed in the respective front and rear side housings 21, 23 as seen in FIG. 4. The pulsating high-temperature air from the discharge chamber 41 first enters the large hollow portion 61 in which the pulsation is eliminated from the air and then passes through the zigzag portions 62, 63 of the accumulator 60 in which the temperature is considerably reduced by heat exchange with the relatively low-temperature suction-side wall of the center housing 22 before the air enters the air-bearing room 40 through the inlet 71 as seen in FIG. 3. The inlet 71 consists of three axially aligned openings as seen in FIG. 4. Therefore, even if the discharge air is high in temperature, the air-bearing room is supplied with low-temperature, high-pressure air to increase the bearing effect.

Figure 5:
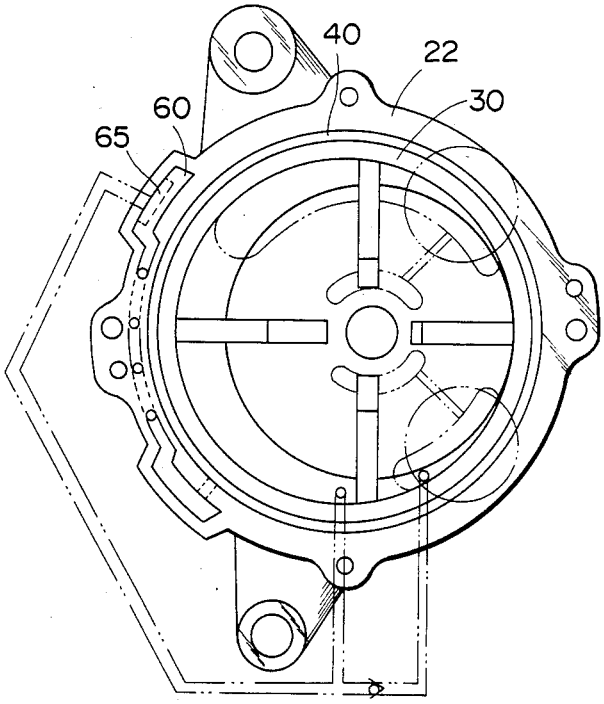
FIG. 5 is a view of a further embodiment, similar to FIG. 1.

As seen in FIG. 5 showing still another embodiment, a strainer 65 is mounted in the accumulator 60 to prevent abrasive sands or the like from entering the air-bearing room 40 and causing wear to the outer surface of the rotary sleeve 30 as well as the inner surface of the center housing 22. The accumulator 60 has two relatively large hollows, one formed in the compression side wall of the center housing and the other in the suction side wall.

Figure 6:
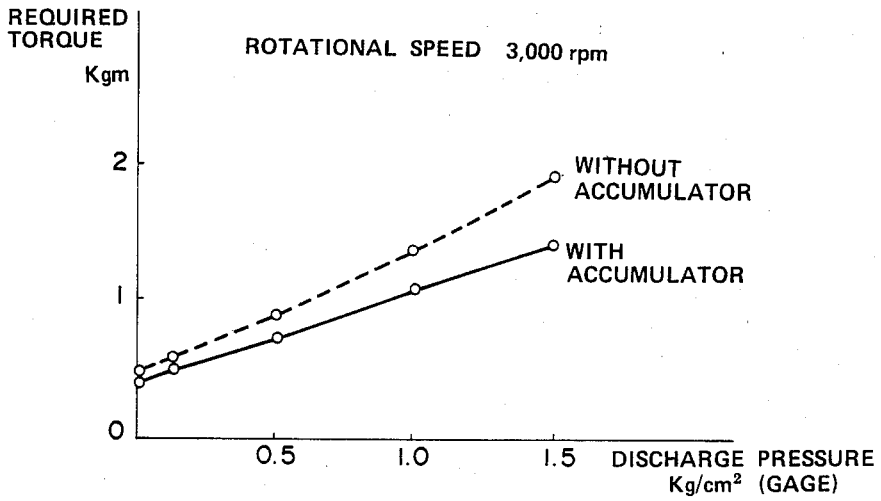
FIGS. 6 and 7 are graphs showing the results of a comparative test between the inventive and kown apparatus.
Figure 7:
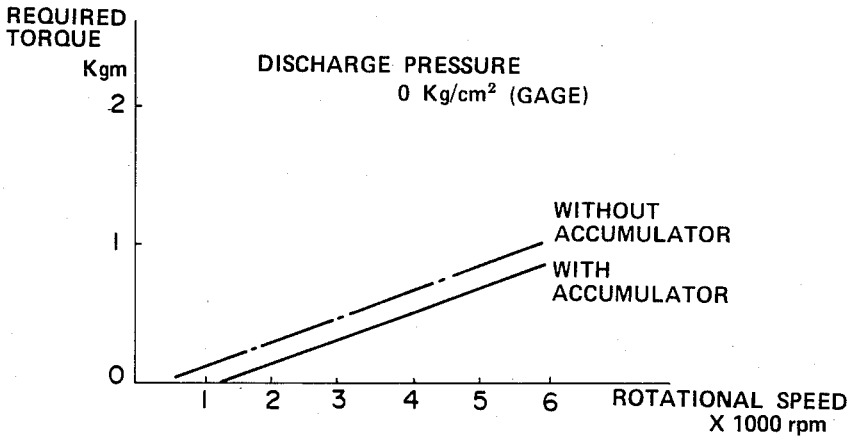

FIGS. 6 and 7 show the results of a comparative test between the compressor with the inventive apparatus which is provided with an accumulator and that with the conventional apparatus without an accumulator. The graphs of FIGS. 6 and 7 show a relationship between torque and discharge pressure when the compressor runs at a constant speed of 3000 rpm and that between torque and rotational speed when the compressor runs at a constant load, respectively. It is apparent from the graphs that the inventive apparatus allows the compressor to require less torque over a full speed range than the conventional and that the difference increases with discharge pressure.

What is claimed is:

1. A rotary-sleeve bearing apparatus for a rotary compressor provided with a center housing, a rotary sleeve rotatably mounted in said center housing, a rotor disposed within said rotary sleeve, a plurality of vanes movably fitted in said rotor, and a discharge chamber, said apparatus comprising an air-bearing room disposed between said center housing and said rotary sleeve, an inlet disposed in the inner surface of said center housing toward which said rotary sleeve would be pushed from within by compressed air, and an air-supply passage extending to said inlet from either or both of said discharge chamber and a compression working space under maximum pressure, said air-supply passage being provided with an accumulator for absorbing pulsations in the air supplied from said discharge chamber and/or said compression working space, said inlet consisting of a plurality of openings aligned with a single axial line in the area of the compression side, inner periphery of said center housing to which said rotary sleeve is pushed from within by the compressed air in said working space.

2. The rotary-sleeve bearing apparatus for a rotary compressor as claimed in claim 1, wherein said accumulator includes a plurality of bores axially passing through the wall of said center housing, and intermittent grooves extending along both side surfaces of said center housing to internally connect said bores.

3. The rotary-sleeve bearing apparatus for a rotary compressor as claimed in claim 1, wherein said air-supply passage comprises a main passage extending from said compression working space to said air-bearing room through said accumulator and an auxiliary passage extending from said discharge chamber to said main passage, said auxiliary passage being provided with a check valve.

4. The rotary-sleeve bearing apparatus for a rotary compressor as claimed in claim 1, wherein said accumulator is provided with a strainer.

5. The rotary-sleeve bearing apparatus for a rotary compressor as claimed in claim 1, wherein said accumulator comprises at least a hollow portion formed in said center housing.

6. The rotary-sleeve bearing apparatus for a rotary compressor as claimed in claim 5, wherein said accumulator comprises at least a relatively large hollow formed in the thickened wall of said center housing.

7. The rotary-sleeve bearing apparatus for a rotary compressor as claimed in claim 2, wherein said accumulator comprises a plurality of bores axially passing through the wall of said center housing, and intermittent grooves extending along both side surfaces of said center housing to internally connect said bores.

8. The rotary-sleeve bearing apparatus of claim 5 wherein the accumulator further includes a system of bores which convey the air from the accumulator to the inlet to the air bearing room, whereby the air traveling through said system of bores loses its heat to its surroundings.

9. The rotary-sleeve bearing apparatus of claim 8 wherein the system of bores is disposed in the center housing and the heat from the air is lost to said center housing.

* * * * *